US006263858B1

(12) United States Patent
Pursifull et al.

(10) Patent No.: US 6,263,858 B1
(45) Date of Patent: Jul. 24, 2001

(54) POWERTRAIN OUTPUT MONITOR

(75) Inventors: Ross Dykstra Pursifull, Dearborn; Allan Joseph Kotwicki, Williamsburg; Charles Francis Weber, South Lyon, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/488,627

(22) Filed: Jan. 20, 2000

(51) Int. Cl.[7] ..... F02D 7/00
(52) U.S. Cl. ..... 123/399; 123/361
(58) Field of Search ..... 123/399, 361, 123/351, 352

(56) References Cited

U.S. PATENT DOCUMENTS

| | | | |
|---|---|---|---|
| 4,094,274 | 6/1978 | Harada et al. . | |
| 4,635,607 | 1/1987 | Yasuoka et al. . | |
| 4,748,955 | 6/1988 | Yonekawa et al. . | |
| 4,890,590 | 1/1990 | Iwamoto et al. . | |
| 5,048,481 | 9/1991 | Chan et al. . | |
| 5,048,482 | 9/1991 | Kratt et al. . | |
| 5,074,267 | 12/1991 | Ironside et al. . | |
| 5,079,946 | 1/1992 | Motamedi et al. . | |
| 5,146,892 | 9/1992 | Krampe et al. . | |
| 5,204,816 | 4/1993 | Wright et al. . | |
| 5,255,653 | 10/1993 | Ironside et al. . | |
| 5,370,094 | 12/1994 | Sorg et al. . | |
| 5,391,127 | 2/1995 | Nishimura . | |
| 5,429,091 | 7/1995 | Huber et al. . | |
| 5,623,905 | 4/1997 | Kau et al. . | |
| 5,623,906 * | 4/1997 | Storhok | 123/399 |
| 5,692,472 | 12/1997 | Bederna et al. . | |

* cited by examiner

*Primary Examiner*—Erick Solis
(74) *Attorney, Agent, or Firm*—John D. Russell

(57) ABSTRACT

A powertrain control method for an internal combustion engine having a throttle responsive to a throttle position command. The method comprises the steps of determining the engine speed, determining the actual throttle position, and generating a desired throttle position value. In one aspect of the invention, the desired throttle position value is generated as a function of the actual throttle position and engine speed. In particular, the throttle position divided by the engine speed can be resolved to a single constant. As such, a simplified powertrain control monitor can be obtained by comparing the throttle position divided by engine speed to a predetermined constant. If the throttle position is greater than the desired throttle position value, the commanded throttle position is limited to the desired value.

9 Claims, 3 Drawing Sheets

POWERTRAIN OUTPUT MONITOR

BACKGROUND OF THE INVENTION

The invention relates generally to control systems for internal combustion engines, and more particularly, concerns a powertrain output monitor for electronic throttle control-equipped vehicles.

Present powertrain output monitor techniques typically compute an estimate of engine output and compare that value to the requested engine output. Such methods typically take the form of resolving one or more engine operating parameters and comparing the estimated versus requested output value. Such operating parameters can include: engine output torque, engine output power, wheel torque, wheel power, and wheel acceleration. The requested output is typically a function of driver demand as measured by the accelerator pedal position, combined with internally automated demands such as idle speed control and catalyst heating.

Due to the complex nature of determining estimated and requested engine output as a function of one or more engine operating characteristics and driver inputs, diagnostics based upon such monitoring techniques are inherently complex. Therefore, there exists a need for a simplified method of monitoring the powertrain control system.

SUMMARY OF THE INVENTION

In view of the foregoing, it is an object of the invention to provide an improved powertrain output monitor. It is also an object to provide a simplified powertrain output monitor as compared to present output monitoring technologies.

According to the present invention, the foregoing and other objects and advantages are attained by a method of monitoring the powertrain output controller for an internal combustion engine having a throttle responsive to a throttle position command. The method comprises the steps of determining the engine speed, determining the throttle position, and generating a desired throttle position value as a function of the engine speed and throttle position. If the actual throttle position is greater than the desired throttle position value, the throttle is commanded to a position equal to the desired throttle position value. In particular, the throttle position divided by the engine speed can be resolved to a single constant. As such, a simplified monitor can be obtained by comparing the throttle position divided by engine speed to a predetermined constant. If the throttle position is greater than the desired throttle position value, the commanded throttle position is limited to the desired value, or other powertrain control action is taken. Such action can include retarding or eliminating the spark timing, reducing or eliminating the quantity of fuel injected, or removing power to the throttle actuator.

An advantage of the present invention is that little or no field calibration is required. Another advantage is that few inputs are necessary, thus, the main control element interface is simplified.

Other advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE PREFERRED EMBODIMENT

Figure 1:
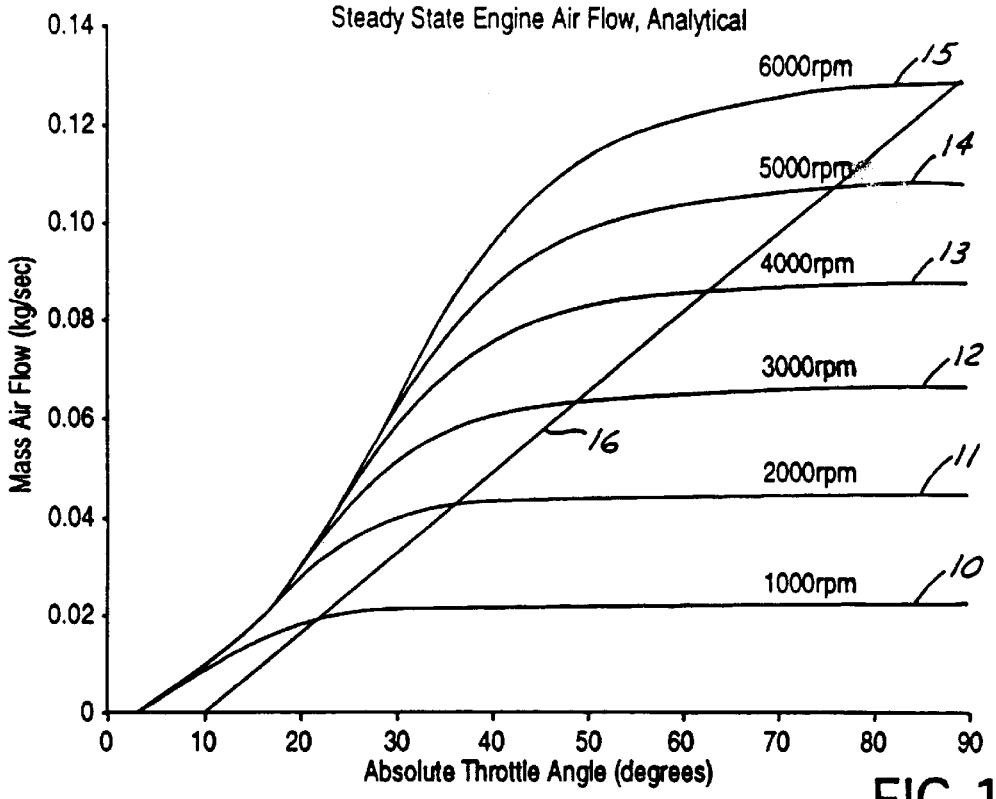
FIG. 1 is a graph of engine mass airflow versus throttle angle for various engine speeds.

Turning first to FIG. 1, there is shown a graph of the engine mass airflow versus absolute throttle angle for an engine operating in steady state at several different engine speeds. As can be seen with reference to lines 10–15, there is a region where changes in the throttle angle have little or no effect on the engine mass airflow. This region is shown in FIG. 1 as the area to the right of line 16. In other words, at 2000 RPM, a commanded change in the throttle angle from 50 to 60 degrees will have virtually no effect on the engine output since the mass airflow does not change.

Figure 2:
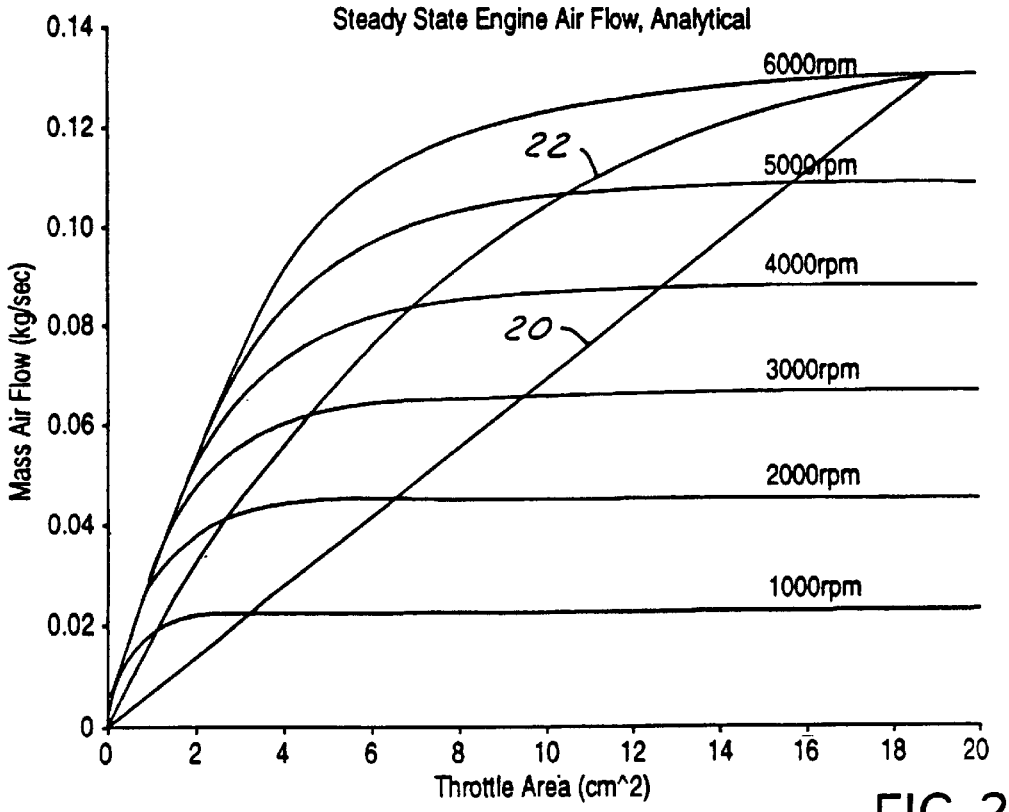
FIG. 2 is a graph of engine mass airflow versus throttle area for various engine speeds.

FIG. 2 shows a similar relationship for the throttle area versus engine mass airflow for an engine operating in steady state at several different speeds. Again, the insensitive throttle position region is defined as all points to the right of line 20 along each engine speed graph. An improved insensitive throttle position indicator is shown as line 22.

From the foregoing graphs illustrated in FIGS. 1 and 2, a relationship can be seen between throttle position and engine speed from which an effective powertrain control monitor can be created.

Figure 3:
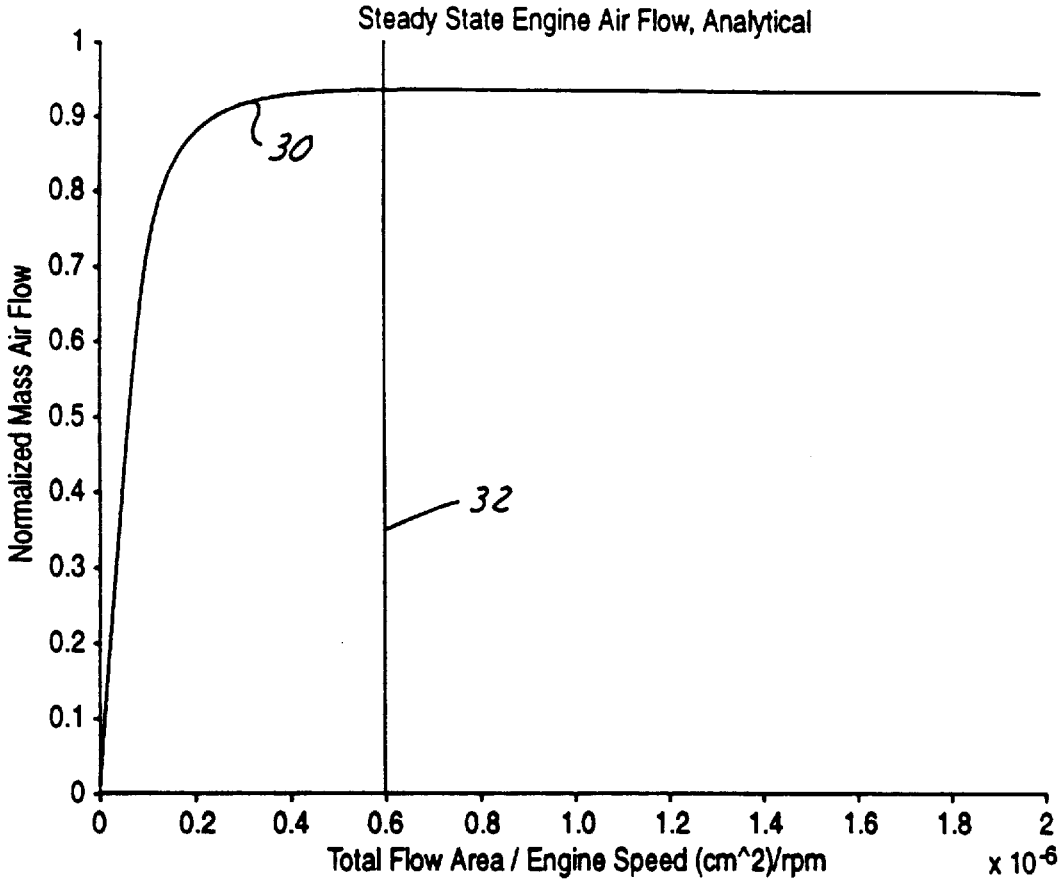
FIG. 3 is a graph of the normalized steady state engine airflow versus the throttle position divided by engine speed.

Referring to FIG. 3, there is shown a graph of the normalized mass airflow versus the value of the total flow area divided by engine speed for each of the curves in FIG. 2. This is represented by line 30. In this case, the normalized mass airflow is equal to the ratio of the mass airflow in each engine cylinder divided by the mass airflow in each cylinder at the standard temperature and pressure. As can be seen, by dividing each axis by engine speed, all of the engine speed curves resolve into a single line 30. From this idealized curve 30, a single scaler value (i.e., 0.6) can be chosen to represent the value above which the throttle position has virtually no effect on the mass airflow. This desired throttle position value is represented as line 32.

Figure 4:
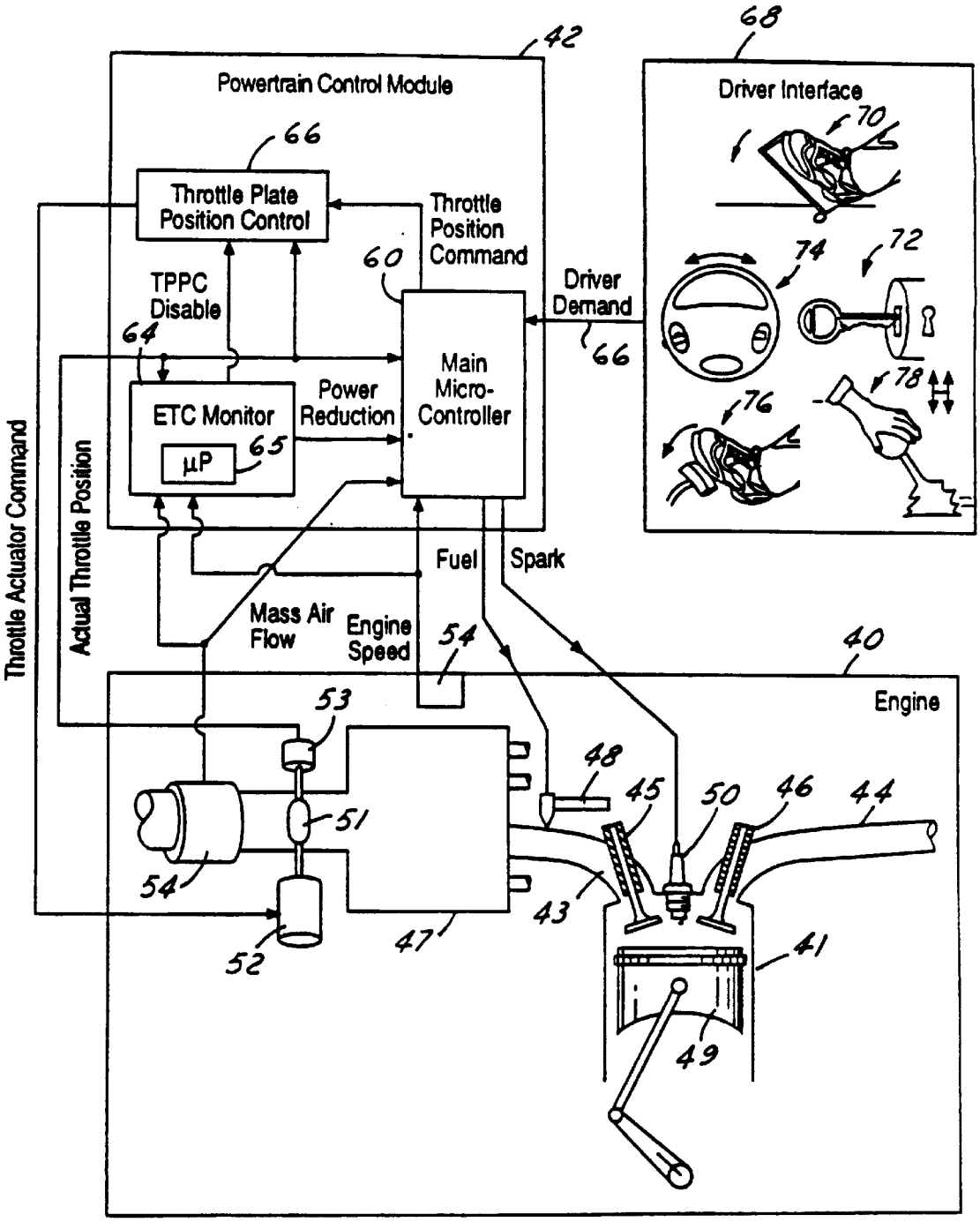
FIG. 4 is a schematic diagram of an internal combustion engine and associated control system according to one embodiment of the present invention.

Referring now to FIG. 4, there is shown a schematic diagram of an internal combustion engine 40 and associated powertrain control module 42 as well as an operator interface 68 in accordance with one embodiment of the present invention.

The engine 40 includes a plurality of combustion chambers 41 each having an associated intake 43 and exhaust 44 operated by respective valves 45, 46. Combustion occurs as a result of the intake of air and fuel from the intake manifold 47 and fuel injector 48 respectively, compression by the piston 49 and ignition by the spark plug 50. Combustion gases travel through the exhaust manifold 44 to the downstream catalytic converter and are emitted out of the tailpipe. A portion of the exhaust gases may also be recirculated back through the intake manifold 47 to the engine cylinders 41.

The airflow through the intake manifold 47 is controlled by a throttle comprising a throttle plate 51 and throttle actuator 52. A throttle position sensor 53 measures the actual throttle position. Mass airflow sensor 54 measures the amount of air flowing into the engine 40. An engine speed sensor 54 provides value indicative of the rotational speed of the engine 40.

The powertrain control module (PCM) 42 receives as inputs the throttle position signal, the mass airflow signal, the engine speed signal, and the driver demand inputs. In response, the PCM 42 controls the spark timing of the spark plugs 50, the pulse width of fuel injectors 48 and the position of the throttle 51 by way of the throttle actuator 52. All of these inputs and outputs are controlled by the main microcontroller 60. The main microcontroller 60 controls the throttle position by outputting a throttle position command to the throttle plate position controller 62 to drive the throttle actuator 52 to the desired position.

The PCM 42 includes an electronic throttle control (ETC) monitor 64 which communicates with the main microcontroller 60 and throttle plate position controller 62. The ETC monitor 64 includes a microprocessor 65 and associated memory separate from the microprocessor in the main microcontroller 60. The ETC monitor 64 receives as inputs the engine speed signal from engine speed sensor 54 and throttle position signal from the throttle position sensor 53. As will be described in further detail below, the ETC monitor 64 monitors the throttle actuation.

Although the ECT monitor 64 is shown as separate from the PCM main microprocesser, it could be partially or wholly integrated into the main microprocesser as well. In addition, the ETC monitor 64 could also be integrated into the throttle plate position controller 62.

The PCM 42 also receives as an input driver demand signals 66. The driver demand signals can include such things as accelerator pedal position 70, ignition switch position 72, steering input 74, brake sensor 76, transmission position input 78, as well as inputs from the vehicle speed control.

In operation, the ETC monitor 64 monitors the throttle position and actuation separate from the main microcontroller 60 which executes the primary throttle position control. The function of the ETC monitor 64 is to detect throttle positions as defined by regions to the right of lines 16, 20, 22 or 32 in FIGS. 1–3. Thus, for a given engine speed as measured by engine speed sensor 54 and throttle position as measured by throttle position sensor 53, the ETC monitor 64 determines whether the throttle is operating in a desired region. Alternatively, the ETC monitor 64 could determine the operating region of the throttle from the commanded throttle position rather than actual throttle position.

From the inputs of engine speed and throttle position (TP), the ETC monitor generates a desired throttle position value. Thus, in systems where the throttle angle and engine speed are measured such as shown in FIG. 1, the desired throttle position value corresponds to all points along line 16. Similarly, in systems measuring the throttle area rather than position, the desired throttle position value corresponds, as shown in FIG. 2, to all points along either lines 20 or 22. Likewise, as shown in FIG. 3, if the total flow area is divided by the detected engine speed, the desired throttle position value resolves to a single constant value which, in this case, is $0.6\times10^{-6}$. Thus, the desired throttle position value can take several forms depending upon the desired system implementation. Several forms of determining the desired throttle position value (DTPV) are as follows:

$$\text{dtpv}=\text{constant}\times(\text{tp}/\text{rpm}) \quad (1)$$

$$\text{dtpv}=\text{constant}\times(\text{rtp}/\text{rpm}) \quad (2)$$

$$\text{dtpv}=\text{constant}\times((\text{rtp}+\text{constant})/\text{rpm}) \quad (3)$$

$$\text{dtpv}=\text{constant}\times(\text{throttle area}/\text{rpm}) \quad (4)$$

$$\text{dtpv}=\text{constant}\times((\text{effective leak area}+\text{throttle area})/\text{rpm}) \quad (5)$$

Alternatively, given the engine mapping data of FIGS. 1, 2 or 3, the ETC monitor 64 could monitor the mass airflow rate and engine speed to derive a corresponding desired throttle position value.

If the actual throttle position as measured by the throttle position sensor 53 is greater than the desired throttle position value as determined above, action can be taken to limit the powertrain output. For example, the commanded throttle position can be limited to the desired maximum throttle position value, or other powertrain control action can be taken. Powertrain control action can include retarding or eliminating the spark timing of the spark plugs 50, reducing the pulse width or eliminating the signal transmitted to the fuel injectors 48, and/or removing power to the throttle actuator 52 causing a throttle plate 51 to go to a partially open state.

By limiting the throttle position to a value where it affects airflow, the response time of any desired powertrain control action related to the throttle position is improved because the throttle will be positioned just outside of the air control boundary instead of being in a region where it does not control airflow. Another advantage of the present invention is that it is completely independent of operator pedal position. Additionally, any commands that drive the throttle to full open can be immediately detected, before they affect airflow.

From the foregoing, it will be seen that there has been brought to the art a new and improved powertrain control monitor. While the invention has been described in connection with one or more embodiments, it will be understood that the invention is not limited to those embodiments. On the contrary, the invention covers all alternatives, modifications, and equivalents, as may be included within the spirit and scope of the appended claims.

What is claimed is:

1. A method of monitoring the powertrain output controller for an internal combustion engine having at least one fuel injector responsive to a fuel command signal and a throttle responsive to a throttle position command signal, the method comprising the steps of:

determining an engine speed;

determining a throttle position;

generating a normalized desired throttle position value as a function of the throttle position and engine speed by determining the throttle area and dividing the throttle area by the engine speed; and if the throttle position is greater than the normalized desired throttle position value, then generating a throttle position command signal to drive the throttle position to a value equal to the normalized desired throttle position value.

2. A method of monitoring the powertrain output controller for an internal combustion engine having at least one fuel injector responsive to a fuel command signal and a throttle responsive to a throttle position command signal, the method comprising the steps of:

determining an engine speed;

determining a throttle position;

determining a throttle area value and generating a desired throttle position value as a function of the throttle area value and engine speed; and if the throttle position is greater than the desired throttle position value, then generating a throttle position command signal to drive the throttle position to a value equal to the desired throttle position value.

3. A method of monitoring the powertrain output controller for an internal combustion engine having at least one fuel injector responsive to a fuel command signal and a throttle responsive to a throttle position command signal, the method comprising the steps of:

determining an engine speed;

determining a throttle position;

determining an effective leak area value and throttle area value, and generating a desired throttle position value as a function of the effective leak area value, throttle area value and engine speed; and if the throttle position is greater than the desired throttle position value, then generating a throttle position command signal to drive the throttle position to a value equal to the desired throttle position value.

4. A method of monitoring the powertrain output controller for an internal combustion engine having at least one fuel injector responsive to a fuel command signal, at least one spark plug responsive to a spark timing signal and a throttle responsive to a throttle position command signal, the method comprising the steps of:

determining an engine speed;

determining a throttle position;

generating a normalized desired throttle position value as a function of the throttle position and engine speed determining the throttle area and dividing the throttle position by the engine speed; and if the throttle position is greater than the normalized desired throttle position value, then adjusting the power delivered to the engine.

5. The monitoring method of claim 4 wherein the step of adjusting the power delivered to the engine includes the step of modifying the pulse width of the fuel command signal.

6. The monitoring method of claim 4 wherein the step of adjusting the power delivered to the engine includes the step of modifying the amount of exhaust gas recirculated into the engine.

7. The monitoring method of claim 4 wherein the step of adjusting the power delivered to the engine includes the step of modifying the spark timing signal.

8. A control system for an internal combustion engine having at least one fuel injector responsive to a fuel command signal, at least one spark plug responsive to a spark timing signal and a throttle responsive to a throttle position command signal, the system comprising:

a throttle position sensor for providing an actual throttle position value;

an engine speed sensor for providing an engine speed value;

a control unit including a microproscessor for receiving the throttle position value and engine speed value, the microprocessor programmed to perform the following steps:

determine a throttle area value and generate a desired throttle position value as a function of the throttle area value and engine speed; and if the throttle position value is greater than the desired throttle position value, then generate a throttle position command signal to drive the throttle position to a value equal to the desired throttle position value.

9. A method of controlling the throttle position of an internal combustion engine comprising the steps of:

detecting an actual throttle position value where it has minimal effect on engine intake airflow; and clipping the throttle position to a normalized desired throttle position value said normalized desired throttle position value corresponding to a throttle area value divided by an engine speed value.

* * * * *